US005203566A

United States Patent [19]

Ricigliano

[11] Patent Number: 5,203,566

[45] Date of Patent: Apr. 20, 1993

[54] SIMULATED GOLF COURSE

[76] Inventor: William Ricigliano, 212 Willowick Dr., Naples, Fla. 33942

[21] Appl. No.: 792,636

[22] Filed: Nov. 15, 1991

[51] Int. Cl.[5] ..... A63B 67/02

[52] U.S. Cl. ..... 273/176 E; 273/176 B; 273/176 D; 273/176 AB

[58] Field of Search ..... 273/176, 32 R, 34 R, 273/178, 179, 181 R, 35 R

[56] References Cited

U.S. PATENT DOCUMENTS

| | | | |
|---|---|---|---|
| 3,342,494 | 9/1967 | Talley | 273/176 F |
| 3,414,266 | 12/1968 | Mitchell | 273/176 J |
| 3,735,988 | 5/1973 | Palmer et al. | 273/176 J |
| 3,843,136 | 10/1974 | Buenzle | 273/176 F |
| 3,885,795 | 5/1975 | Brewer | 273/176 J |
| 4,743,026 | 5/1988 | Eady | 273/176 F |
| 4,934,704 | 6/1990 | Mazer | 273/176 J |

OTHER PUBLICATIONS

Certificate of Copyright Registration #188,828 Dec., 1990.

*Primary Examiner*—Mark Graham
*Attorney, Agent, or Firm*—Alfred M. Walker

[57] ABSTRACT

An indoor miniature golf game is provided with a plurality of fairways and greens. Sequential visual activity segments with intermediate target areas are provided on the fairways between the tees and the greens. Various materials both visually and physically simulate the accompanying landscape, so that the golf ball travels quickly over the greens, but is slowed down and caught by rough or water simulated areas.

2 Claims, 3 Drawing Sheets

SIMULATED GOLF COURSE

BACKGROUND OF THE INVENTION

The present invention relates to an indoor, miniature simulated golf course game. It has a particular configuration of a plurality of fairway driving areas between the tees and the greens. The fairways, between the holes and tees, provide sequential visual activity segments with intermediate golf ball target areas between the tees and the greens. The intermediate golf ball target areas are constructed in proportional size to the distance of the intermediate target zone area from each respective tee.

The game also simulates a golf course by selective choice of carpet materials to simulate the ball interacting resistive properties of various parts of the golf course. For example, the greens are made from short, tighter fabric with short, densely placed carpet tufts to accelerate the movement of the golf ball as if on a green. Also, the fairways have tightly packed fabric, but with higher strands to add resistance and slow down the movement of the golf ball. Finally, the areas which simulate roughs with bushes, sand traps or water traps are made from looser fabrics to slow down and stop the movement of the golf ball. Therefore the speed of the golf ball is affected by the various fabrics to simulate the various speeds and entrapments of the golf ball throughout the golf course.

DISCUSSION OF THE PRIOR ART

Various attempts have been made to design miniature golf courses which provide a playing field on a small scale, but these courses do not simulate the material of the terrain as a function of the speed and travel of the golf ball. Nor do these golf course games provide a means of testing visual acuity, such as is provided by the present invention with intermediate target zones which increase in size as the size from the tee to the intermediate target zone increases. Such prior art golf games are noted in U.S. Pat. Nos. 1,503,720 of Strasser, 1,591,095 of Meyer, 3,671,042 of Garber, 3,604,710 of Jacobs, 3,427,030 of Ward, 3,649,027 of Vallas, 3,892,413 of Rotolo, 3,904,209 of Thomas, 3,534,961 of Tiley, 4,019,748 of Healey and 4,673,183 of Trahan.

SUMMARY OF THE INVENTION

The plan of the course of the present invention may be accomodated to various sites of varying terrain. It is well suited for an indoor site of limited size for indoor use.

The plan of the course may be easily constructed with varying carpet materials, which are selected to affect the movement and speed of the golf ball so as to simulate different playing conditions.

For example, thick but loosely strung tufts of carpet are provided to simulate water, sand and rough hazards. These thick but loosely strung tufts of carpet constituite a retention means capable of slowing down and partially retaining the golf ball as it travels towards its intended destination. In addition, the terrain may be three dimensional by providing concrete free-form bases for the carpeted surfaces. An advantagous characteristic, according to the invention, is that three dimensional curvature of the terrain aids in directing the golf ball towards its destination.

The present invention is intended to simulate the surface characteristics of the golf course on a minitaure scale, so that the golf ball increases its speed or slows down, depending upon what characteristic terrain it encounters during its path of travel.

For example, the looser but taller strands of carpet tufts simulating the water, sand or rough hazards will by virtue of the height of the tufts and the density of the placement of the tufts, slow down and capture the ball, interrupting its movement, as occurs in a real golf game when the golf ball strikes water, sand or bushes in the rough.

On the other hand, shorter tufts, which are more densely placed, are provided to simulate the grass of the fairways. Since the strands are shorter, they do not have the height to fully capture the balls and interrupt their travel. However the tufts will by virtue of their height and density slow down the movement of the golf ball.

Furthermore, the carpet simulating the densely packed greens with the holes will be short and very densely packed, to allow the golf ball free movement without substantially slowing down the golf ball during putting on a green.

Another feature of the invention is that the fairways are generally designed with angled dog leg configurations, so that a golf ball has to be hit around a corner. To test the player's visual acuity to land a golf ball at a particular elbow of a dog leg shaped fairway, intermediate target zone or scoring zones, generally circular, are provided. As a result, a player cannot by sheer force unsafely hit the golf ball through the dog leg by bouncing it against the terrain features in contravention of typical golf ball travel flow.

By providing the intermediate target areas, the game requires the golf player to accurately land on the intermediate target area before proceeding to the green at the end of the fairway.

To increase variety and to simulate differing lengths of fairways in real life, the diameter of each circular intermediate target area varies in proportion to the length which the intermediate target area is located away from the tee at the beginning of each fairway. For example, if the intermediate target area is 22 feet from the tee, then the diameter of the intermediate target area is a fairly large 22 inches in diameter. On the other hand, if the intermediate target area is only 8 feet from the tee, then the intermediate target area is only 8 inches in diameter.

Therefore, the larger the intermediate target area, the greater its distance is from the tee. This requires a player to test his or her visual acuity, because the perceived visual size of the intermediate target area increases or decreases in proportion to its distance from the respective tees. It also simulates the apparent visual decrease in size of the elbows of the dog legs as they are farther away from the view of the player, similar to a vanishing line in perspective. As a result, the intermediate target areas appear uniform in size, even as they are farther away and larger than closer intermediate target areas.

DESCRIPTION OF THE DRAWINGS

Other characteristics and advantages of the invention will become more apparenty from the following description of the drawings, in which.

DESCRIPTION OF THE PREFERRED EMBODIMENT

Figure 1:
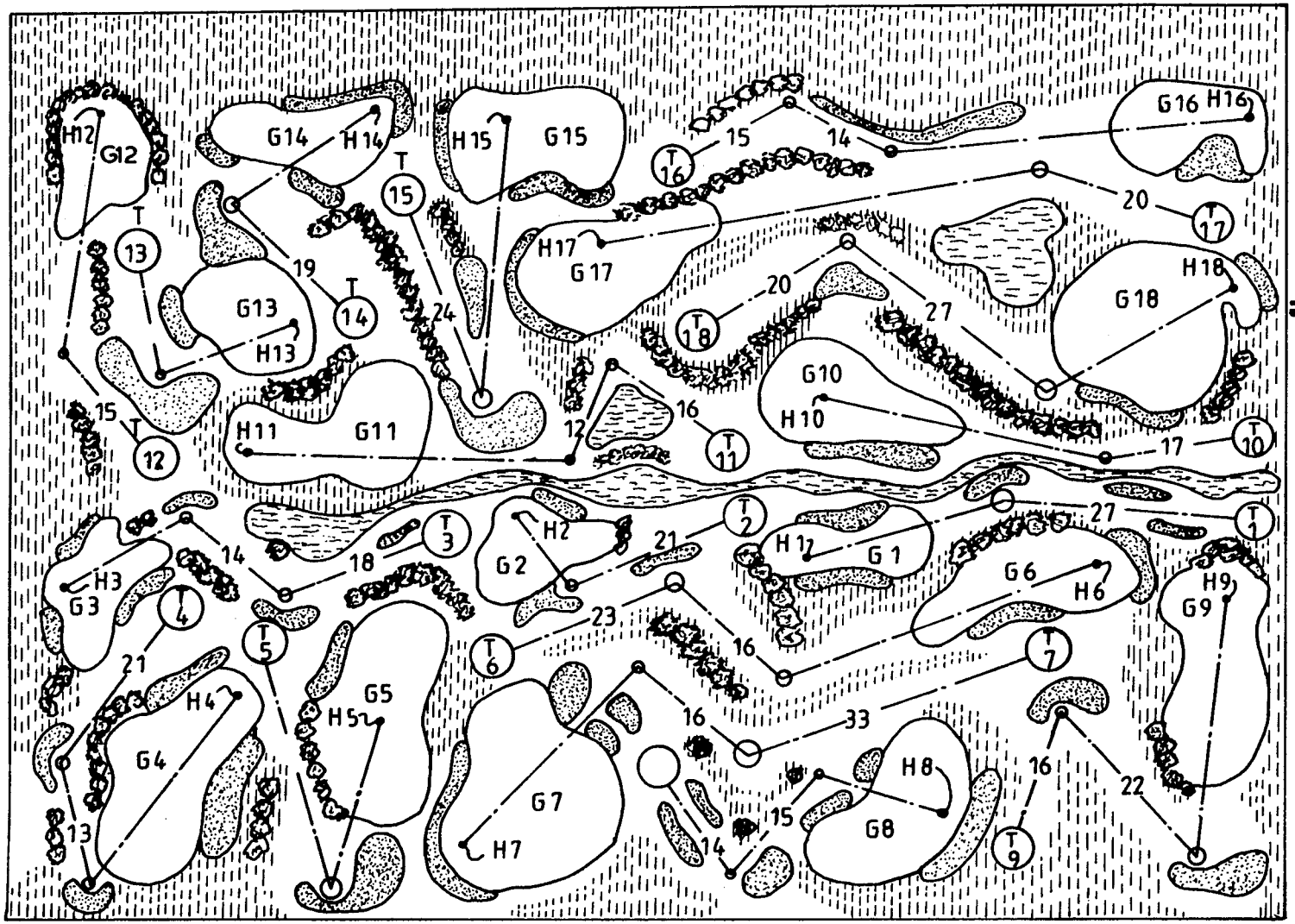
FIG. 1 is a top plan view of the miniature, simulated golf course game.
Figure 2:
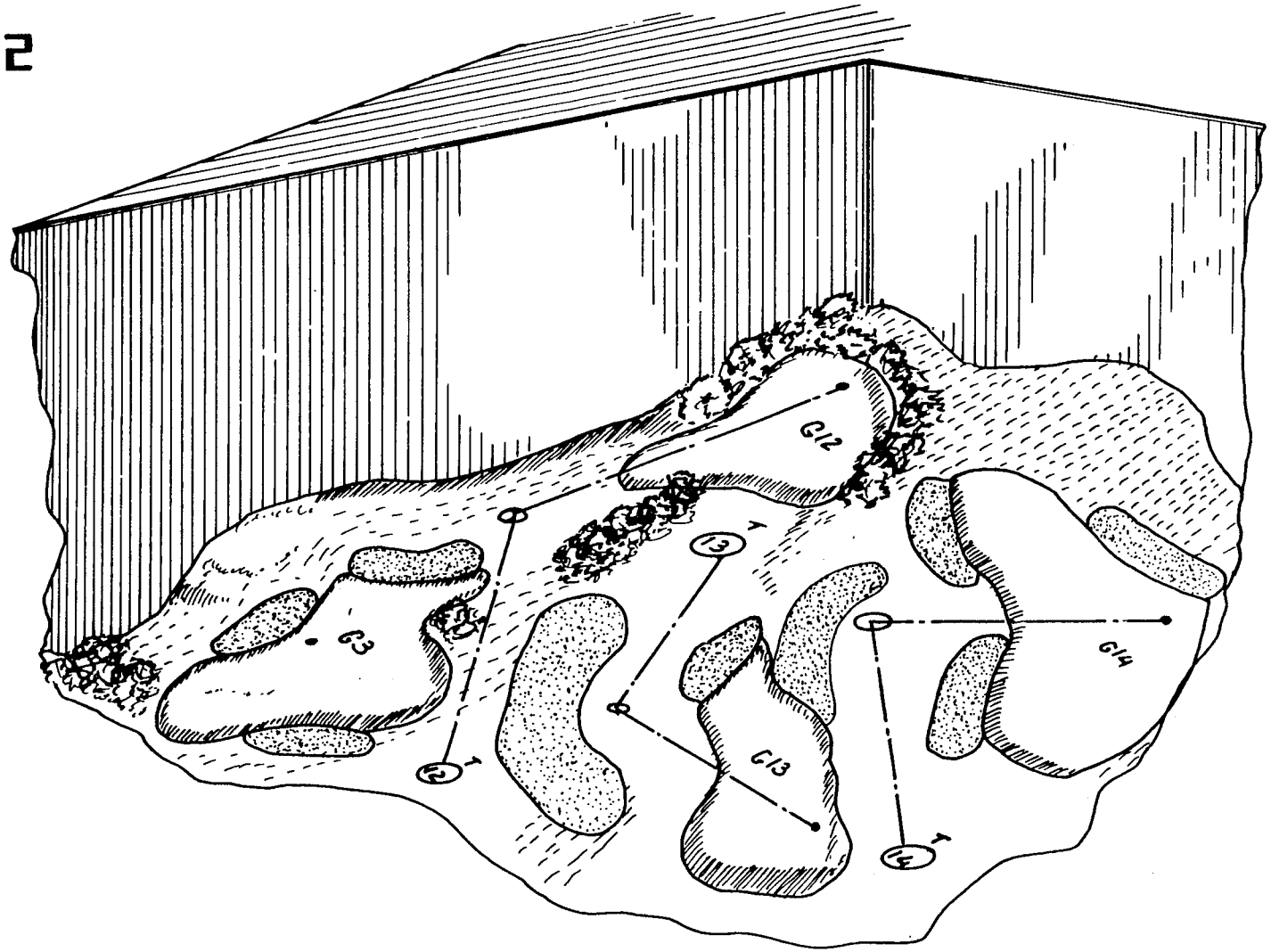
FIG. 2 is a close-up perspective view of a portion of the golf course as shown in FIG. 1.

Referring now to FIGS. 1 and 2, the simulated miniature golf course game is comprised of a series of carpeted miniature tees T1 to T18 inclusive, fairways F1 through F18 inclusive, and greens G1 through G 18 inclusive, with holes H1 through H18 inclusive, interspersed by simulated water hazards W1 through W3 inclusive, sand hazards S1 through S18 inclusive and rough hazards R1 through R18 inclusive.

As noted in FIG. 2, the various rough hazards, such as R2, may be three dimensional to simulate three dimensional terrain. This is accomplished by using three dimensional bases, such as concrete or wire impregnated ferro-cement netting, under the various carpeted surface features, such as green G3, sand hazards S3B, S3C and S3D and rough hazard R2.

Figures 3, 4, 5:
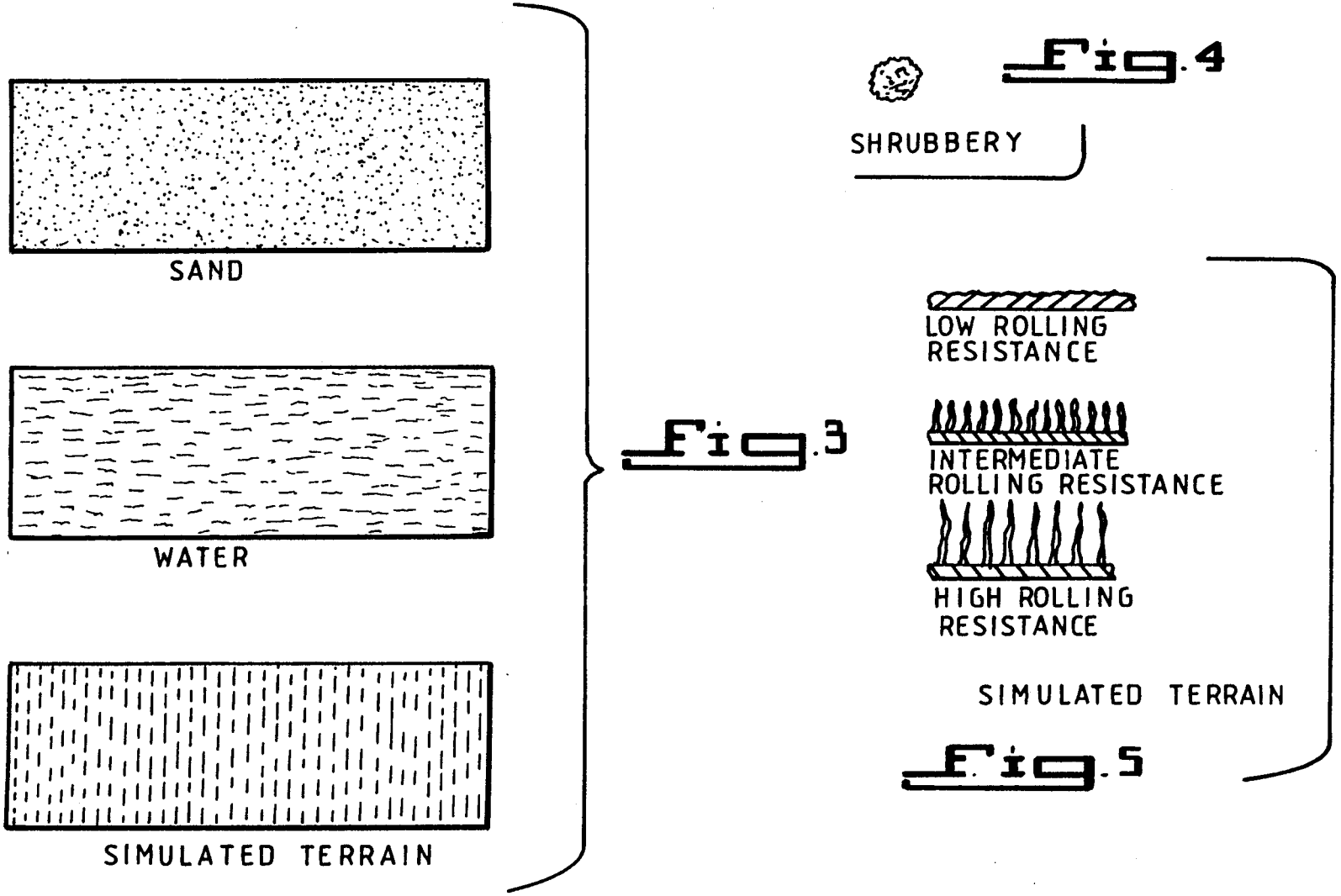
FIG. 3 is an illustration of the stippled codes for the various simulated terrain materials.
FIG. 4 is a close up top plan view of a sample simulated tree.
FIG. 5 shows several close-up side sectional views of the various carpet tufts constituting various natural surface components.

As noted in FIG. 3, the various terrain features such as sand, water or simulated terrain are noted in the drawing FIGS. 1-5 with stippled gradations of inked lines and tones.

FIG. 4 is a top plan view of a specimen simulated tree, the leaves of which are made from artificial silk or lichen.

FIG. 5 shows side elevational sectional views of the various tufts of carpet, which simulate various terrain and function to slow down or accelerate the travel of the golf ball. As noted, FIG. 5 depicts the carpet tufts of green G1 with a low rolling resistance, b virtue of the densely packed, short tufts. Fairway F1 is depicted with higher, but less densely packed tufts to generally allow free movement of the golf ball. Furthermore sand hazard S1 is constituted from taller, looser tufts spaced farther apart to interrupt the travel of the ball and retard its movement, capturing it as a retention means, such as how a sand trap interrupts the travel of a golf ball.

Referring now also to the drawing FIGS. 1 and 2, each fairway, such as F1, is shaped like a dog leg thus having first and second axial directions angled with regard to one another with an elbow portion. Within the elbow portion of fairway F1 there is located intermediate target area I1, generally circular, the diameter of which is proportional in inches to the extent of the distance from tee T1 to intermediate target area I1. In this case, the intermediate target area I1 is 27 inches in diameter, since the center of it is located 27 feet from tee T1.

Likewise, where intermediate target area I8 is only 14 feet from tee T8, therefore intermediate target area I8 is only 14 inches in diameter. Since intermediate target area I8 is smaller, its distance from tee T8 is proportionally smaller than the distance of larger intermediate target area I1 is from tee T1 thus each circular intermediate target area has a predetermined ratio of a sized diameter directly proportional to a predetermined sized distance of said circular intermediate target area from the tee of its respective said fairway. The ratio of said sized diameter of each said circular intermediate target areas to the respective said distance of said circular intermediate target area from its tee being identical to each ratio for each other of said sized diameter of each other circular intermediate target areas to each other of their respective distance of said circular intermediate target areas from each of their respective tees. It is also to be noted that green G1 contains hole H1 into which the golf balls are hit into for the play for that particular hole H1.

Also, rules are promulgated such that a person who lands directly upon intermediate target area I1 from tee T1 is entitled to have one stroke subtracted from the score of play of the simulated golf game. This presents a further incentive for the player to accurately hit the ball to the intermediate target area I1, without trying to hit the ball through the dogleg of fairway F1 in an overly brisk manner to green G1 in an unnatural, careening travel of the ball to tee T1, which does not simulate the incremental hitting of the ball in real play of a full size golf course from a tee to an elbow of a full length doglegged fairway.

The drawings FIGS. 1 and 2 depict typical holes of a simulated golf course plan, but it is be understood that each simulated golf course as embodied in the present invention may have varying unique characteristic features, according to the terrain sought to be simulated on a miniature scale.

For example, a generally flat coastal type golf course may be simulated with more intricate sand and water hazards, whereas a topographically varied hillside or mountainous course may be simulated with more obstructive rough terrain hazards, depending upon the geographic type of golf course to be imitated.

The carpeted surfaces may be pile fabric such as indoor-outdoor carpeting with short, densely packed tufts of carpeting for greens G1 through G18 inclusive, where appropriate. The smooth surface of the indoor-outdoor carpeting with provide little friction to slow down the golf ball upon simulated green G1. On the contrary, normal household everyday use carpeting may be provided for fairways F1 through F18 inclusive, to generally permit smooth travel of the golf ball, while applying a signifigant amount of friction to slow down the golf ball as it travels toward intermediate target areas I1 through I18 inclusive, or from intermediate target areas I1 through I18 inclusive toward greens G1 through G18 inclusive, having holes H1 through H18 inclusive. Finally, hazards such as sand hazards S1 through S18 inclusive or water hazards W1 through W3 are constituted from very plush carpeting with tall tuft strands which are loosely spread apart to act as a retention means to physically slow down and capture the golf balls, as water and sand hazards do in real life.

Capturing of the ball in hazards W1-W3 or S1-S18 will be attained by slackening the speed of the ball from the increased friction of the tall loose tuft strands of hazards W1-W3 or S1-S18 upon the golf ball, since the taller, looser tufts of carpeting will slacken the travel of the ball, and urging the tufts themselves against and around the golf ball.

The looseness of the tuft strands of the hazards W1-W3 and S1-S18 partially form depressed cavities into which the bottoms of the golf balls travel, exerting pressure upon the golf balls to capture them, simulating the capturing of a golf ball within a real water hazard or real sand trap. As the golf balls further travel slowly within the hazards W1-W3 or S1-S18, they are retained until stopped from motion by the pressure of the tall loosely packed tufts upon the ball.

It is noted that the collection of tall strands in the simulated hazards W1–W3 or S1–S18 begin to mesh and converge together in front of the ball travelling laterally against the tall tuft strands, as the advancing golf ball comes in contact with the plurality of tall tuft strands in front of it.

For safety reasons, no airborne strokes of the golf ball are permitted. The circular intermediate target areas comprise the simulated miniature golf course a plurality of visually distinguishable scoring zones of different values, with the different valued scoring zones corresponding to a reduction of a score of a player by a scoring stroke when a golf ball lands on one of the plurality of visually distinguishable scoring zones. Because of the fact that a player substracts a stroke if the player hits the golf ball to one of the proportionately sized circular intermediate target areas I1 through I18, there is an incentive to safely and accurately hit the ball only upon the surfaces of the fairways F1–F18, as indicated by white areas with the dot-and-dash lines indicated the imaginary distances from the tees T1–T18 to intermediate target areas I1–I18.

With the foregoing in mind, it is apparent that the any embodiment resulting routine experimentation of the teachings of this invention shall be deemed to be within the scope of this invention as noted in the appended claims.

I claim:

1. A miniature simulated golf course comprising:

a plurality of fairways with tees and holes for golf balls, each fairway having a tee-area and a hole, each fairway having at least one circular intermediate target area spaced between each said tee area and each said hole at a substantial distance from each other;

each said circular intermediate target area having a predetermined ratio of a sized diameter directly proportional to a predetermined sized distance of said circular intermediate target area from the tee of its respective said fairway, said ratio of said sized diameter of each said circular intermediate target areas to the respective said distance of said circular intermediate target area from its tee being identical to each ratio for each other of said sized diameters of each other circular intermediate target areas to each other of their respective said distances of said circular intermediate target areas from each other of their respective said tees;

said fairways having greens made of a dense pile fabric material with tufts of short height, said fairways being made of a pile fabric of intermediate density with tufts of taller height, said fairways surrounded by interspersed simulated water, sand and rough hazard areas, each said simulated water, sand and rough hazard areas comprising a retention means adapted to slow down and capture one of said golf balls, said retention means including a plurality of taller strands of loosely packed pile fabric tufts capable of meshing and converging together upon the application of pressure from the lateral forward movement of said golf ball against said plurality of taller strands of loosely packed pile fabric tufts; each said fairway having a first axial direction from its respective said tee to its respective said circular intermediate target zone and a second axial direction from its respective circular intermediate target zone toward a hole, said first and second axial directions being angled with respect to each other.

2. A simulated, miniature golf course according to claim 1 wherein said circular intermediate target areas comprise a means to delineate on said simulated miniature golf course a plurality of visually distinguishable scoring zones of difference values, with said different valued scoring zones corresponding to a reduction of a score of a player by a scoring stroke when said golf ball lands on one of said plurality of visually distinguishable scoring zones.

* * * * *